US006581417B2

(12) United States Patent
Yui

(10) Patent No.: US 6,581,417 B2
(45) Date of Patent: Jun. 24, 2003

(54) KNIT WEAR KNITTING METHOD

(75) Inventor: Manabu Yui, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/169,730

(22) PCT Filed: Jan. 24, 2001

(86) PCT No.: PCT/JP01/00488

§ 371 (c)(1),
(2), (4) Date: Jul. 16, 2002

(87) PCT Pub. No.: WO01/57299

PCT Pub. Date: Aug. 9, 2001

(65) Prior Publication Data

US 2003/0010068 A1 Jan. 16, 2003

(30) Foreign Application Priority Data

Jan. 31, 2000 (JP) ..... 2000-027221

(51) Int. Cl.[7] ..... D04B 7/10
(52) U.S. Cl. ..... 66/176; 66/170
(58) Field of Search ..... 66/70, 69, 75.1, 66/189, 170, 171, 172 R, 175, 176, 169 A, 68, 169 R

(56) References Cited

U.S. PATENT DOCUMENTS 3,640,097 A * 2/1972 Betts et al. ..... 66/176
3,702,068 A * 11/1972 Betts et al. ..... 66/176
5,203,185 A * 4/1993 Okuno ..... 66/171
5,826,445 A * 10/1998 Okamoto ..... 66/70
5,916,272 A 6/1999 Nonnenmacher et al.
5,987,930 A 11/1999 Nakai
6,286,340 B1 * 9/2001 Yui ..... 66/70

FOREIGN PATENT DOCUMENTS

| | | |
|---|---|---|
| EP | 470789 A | 2/1992 |
| JP | 6-235148 | 8/1994 |
| JP | 2000-256947 A | 9/2000 |

* cited by examiner

*Primary Examiner*—Danny Worrell
(74) *Attorney, Agent, or Firm*—Rothwell, Figg, Ernst & Manbeck

(57) ABSTRACT

A method of knitting knitwear comprises the joining knit step comprising the step that whenever an adequate number of courses of the front body 3*a* and the back body 3*b* are knitted by using different yarn feeders, both right and left sleeves 5, 7 are shifted to the body side and joined together; and the step that when the front body 3*a* and the back body 3*b* are knitted by different feed yarns, respectively, and the yarn is fed to either of the right and left sleeves 5, 7 to form stitches in the next course, split knit is provided for stitches of the front sleeves 5*a*, 7*a* and back sleeves 5*b*, 7*b* at side ends thereof on the body side and then the stitches formed by the split knit are laid over the stitches of the different courses in the bodies 3*a*, 3*b*, respectively, to join together the sleeves 5, 7 and the body 3. In this joining knit, whenever a predetermined number of courses of the body 3 is knitted, the sleeves 5, 7 are shifted to the body 3 to allow the stitches of the last course of the sleeves 5, 7 to be laid over the stitches of the body 3, and as such can produce knitwear 1 having a good-looking joining line at any selective sleeve attaching angle.

2 Claims, 11 Drawing Sheets

KNIT WEAR KNITTING METHOD

CROSS REFERENCE TO RELATED APPLICATION

This application is a 35 USC 371 National Phase Entry Application from PCT/JP01/00488, filed Jan. 24, 2001, and designating the U.S.

TECHNICAL FIELD

The present invention relates to a method of knitting knitwear whose sleeves and body are joined by using a flat knitting machine.

BACKGROUND ART

The knitting method of joining together knitted fabrics knitted in different regions on the flat knitting machine in the course of the knitting process can eliminate or simplify the tail end sewing process. The application of this knitting method to the knitting of sweater and the like enables the knitting of knitwear which is called a non-sewing knitted fabric.

When sweater is knitted in the form of the non-sewing knitted fabric, the front and back bodies are knitted into a tubular body continuously joined at each end thereof. In parallel with this, the right and left sleeves situated at each side of the body are each knitted into a tubular form and shifted to the body side, so that the sleeves and the body are overlapped and joined together in a joining region extending from the underarm to the shoulder.

The sleeves and the body are joined together to have a proper angle θ formed by the sleeve and the body joined together (hereinafter it is referred to as "the sleeve attaching angle"). This sleeve attaching angle θ can be adjusted by changing a course number ratio between the sleeve and the body after the start of knitting of joining together the sleeve and the body. With reference to FIGS. 12A and 12B, the knitting method of adjusting the sleeve attaching angle θ will be described. FIG. 12A shows the knitting sequence for the process of joining together the sleeves and the body. FIG. 12B shows sweater 101 whose sleeves and body are joined together in accordance with the knitting sequence of FIG. 12A. The line W—W represents the boundary between a front fabric comprising a right front sleeve 105*a*, a front body 103 and a left front sleeve 107*a* and a back fabric comprising a right back sleeve 105*b*, a back body 103*b* and a left back sleeve 107*b*.

In the knitting method of FIG. 12, a single yarn feeder is used for knitting both of the front fabric and the back fabric. In the course 111, after the yarn is continuously fed to the right front sleeve 105*a* and the front body 103*a*, the right front sleeve 105*a* and the left front sleeve 107*a* are shifted to the body, respectively, to be joined to the front body. Sequentially, in the courses 113–117, the knitting that whenever the front fabric is knitted in one course, the right front sleeve 105*a* and the left front sleeve 107*a* are shifted to and joined to the front body 103*a* is repeated five times. In the course 119, after the front body 103*a* and the left front sleeve 107*a* are continuously knitted, the right front sleeve 105*a* and the left front sleeve 107*a* are shifted to the front body 103*a*, so that the sleeves and the front body are joined together. Then, the knitting goes on to the knitting of the back fabric. In the course 121, after the left back sleeve 107*b* and the back body 103*b* are continuously knitted, the right back sleeve 105*b* and the left back sleeve 107*b* are shifted to the body, respectively, to be joined to the back body.

Sequentially, in the courses 123–127, the knitting that whenever the back fabric is knitted in one course, the right back sleeve 105*b* and the left back sleeve 107*b* are shifted to and joined to the back body 103*b* is repeated five times. In the course 129, after the back body 103*b* and the right back sleeve 105*b* are continuously knitted, the right back sleeve 105*b* and the left back sleeve 107*b* are shifted to the body, so that the sleeves and the back body are joined together. The sleeve attaching angle θ varies depending on the course number ratio of the sleeve to the body after the start of the joining knit to join together the sleeve and the body. As the course number ratio of the body to the sleeve is increased, the sleeve attaching angle θ increases and comes nearer to a right angle. On the other hand, as the course number ratio of the body is reduced, the sleeve attaching angle θ reduces and comes nearer to a parallel with the body.

In the knitting method mentioned above, in the courses 113–117 and 123–127, the knitting of the sleeves 105, 107 is suspended and the knitting to join either of the front and back bodies and the sleeves is continuously performed. During this course knitting, only either of the front knitted fabric and the back knitted fabric is reduced in knitting width. When this knitting wherein the knitting of the sleeves is suspended and the joining knit to continuously join the sleeves and the body of either of the front knitted fabric and the back knitted fabric is repeated five consecutive times, as shown in FIG. 12, the stitches on the edge of the front knitted fabric and the stitches on the edge of the back knitted fabric will be moved away from each other by five stitches. This may cause the problems of causing yarn rupture in the yarn extending between the stitch on the edge of the front knitted fabric and the stitch on the edge of the back knitted fabric, thus interrupting the knitting operation and of generating in the knitwear an undesirable knitted line to significantly spoil the commercial value of the product. If the sleeves are not knitted but are shifted to and joined to the body repeatedly, in order to bring the sleeve attaching angle θ closer to right angle, then the same stitch will be transferred over and over again by the time the knitting of the sleeves suspended is restarted. As a result of this, the stitch laid over the stitch of the body is strung out. This may cause an undesirable hole in the joining line 109*a*, 109*b* along which the sleeves and the body are joined together, to give a dirty-looking to the joining line, or may cause yarn breakage.

Meanwhile, the applicant discloses in JP Laid-open (Unexamined) Patent Publication No. A-2000-256947 the knitting method using an elastic yarn for joining together the sleeves and the body. This knitting method comprises the step that while the sleeves and the body are both knitted, the sleeves are shifted to the body and joined to it; the step that the knitting of the body is suspended, during which the knitting of sleeve caps of the sleeves is continued in a flechage knitting, and then the last course of the sleeves is knitted by using the elastic yarn; and the step that the knitting of the body is restarted, so that the sleeves and the body are joined together along the sleeve caps by transferring stitches whenever a predetermined number of courses of the body are knitted. After these steps, the sleeves and the body are joined together. In this knitting method, since the sleeve caps are knitted into a desired shape in the flechage knitting and since after completion of this flechage knitting, the sleeves are joined to the body along their sleeve caps without knitting the sleeve caps, the shape of the sleeves and the sleeve attaching angle can both be freely set. In addition, since the last course of the sleeves is formed by using the elastic yarn, even when the same stitch is transferred sequentially, there is little fear of causing yarn breakage or stringing out the stitches.

It is the object of the present invention to disclose a knitwear knitting method comprising the step that tubular sleeves are knitted at each side of a tubular body; and the step that the sleeves are shifted to and joined to the body in a joining region in which the sleeves and the body are to be joined together, wherein the knitwear having a good-looking joining line along which the sleeves and the body are joined together can be knitted at any selective sleeve attaching angle. It is another object of the present invention to disclose a knitting method of knitting knitwear that requires no special yarn, such as an elastic yarn, for joining together the sleeves and the body at a large sleeve attaching angle close to right angle.

DISCLOSURE OF THE INVENTION

To solve the problems mentioned above, the present invention provides a method of knitting knitwear, comprising a body knitted into a tubular fabric whose front body and back body are overlapped with each other in front and back; and right and left sleeves situated at each side of the body and each formed into a tubular fabric whose front sleeve and back sleeve are overlapped with each other in front and back, by using a flat knitting machine comprising at least a pair of first and second needle beds each having a number of needles, which are placed opposite in front and back and at least either of which can be racked laterally; yarn feeders for feeding yarn to the needles of the first needle bed and second needle bed; and a cam unit, the method comprising the joining knit step that whenever a predetermined number of courses of the body is knitted in a joining region extending from an underarm to a shoulder, the sleeves are shifted to the body to allow the stitches of the last course of the sleeves to be laid over the stitches of the body, so as to join together the sleeves and the body, the joining knit step comprising:

a) the step that whenever an adequate number of courses of the front body and the back body are knitted by using different yarn feeders, the right and left sleeves are shifted to the body side and joined together; and b) the step that when the front body and the back body are knitted by the different feed yarns, respectively, and the yarn is fed to either of the right and left sleeves to form stitches in the next course, split knit is provided for stitches of the front sleeves and back sleeves at side ends thereof on the body side and then each of the split stitches are laid over the stitches of the different courses in the bodies to join together the sleeves and the body.

According to the construction of the present invention, the knitting that the body and the right and left sleeves are each knitted into a tubular form up to underarm; different yarn feeders are used for knitting the front body and the back body in the joining region extending from the underarm to the shoulder; the yarn feeders are reversed in direction at each end of the body to perform the flechage knitting; and whenever an adequate number of courses of the body are knitted, the right and left sleeves are shifted to the body side so the front sleeves and the front body can be overlapped with the back sleeves and the back body to be joined together is taken as unit of repeated knitting operations. In the step 1, this unit of repeated knitting operations is repeated to join together the sleeves and the body. Sequentially, the knitting that when the front body and the back body are knitted by using the different yarn feeders and the yarn is fed to either of the right and left sleeves to form stitches of the next course in the sleeves, the split knit is provided for the stitches of the front and back sleeves at side ends thereof on the body side; one of a split stitch and an added stitch provided by the split knit is laid over the stitch of the body to form the stitch of the next course in the body; and the other of the split stitch and the added stitch is laid over the stitch of the body to form the stitch of the next course in the body is alternately made for the right and left sleeves. This knitting is taken as unit of repeated knitting operations. In the step 2, this unit of repeated knitting operations is repeated to join together the sleeves and the body. Subsequently, the step 1 and the step 2 are repeatedly taken in an alternate order to join together the sleeves and the body.

In the method of knitting knitwear of the present invention, a course number ratio of the sleeve to the body after the start of the joining knit of the sleeve and the body is set so that a course number ratio of the body can be higher than 1:4. This construction of the present invention can produce the knitwear having the sleeves joined to the body at a large sleeve attaching angle.

BEST MODE FOR CARRYING OUT THE INVENTION

Figure 1:
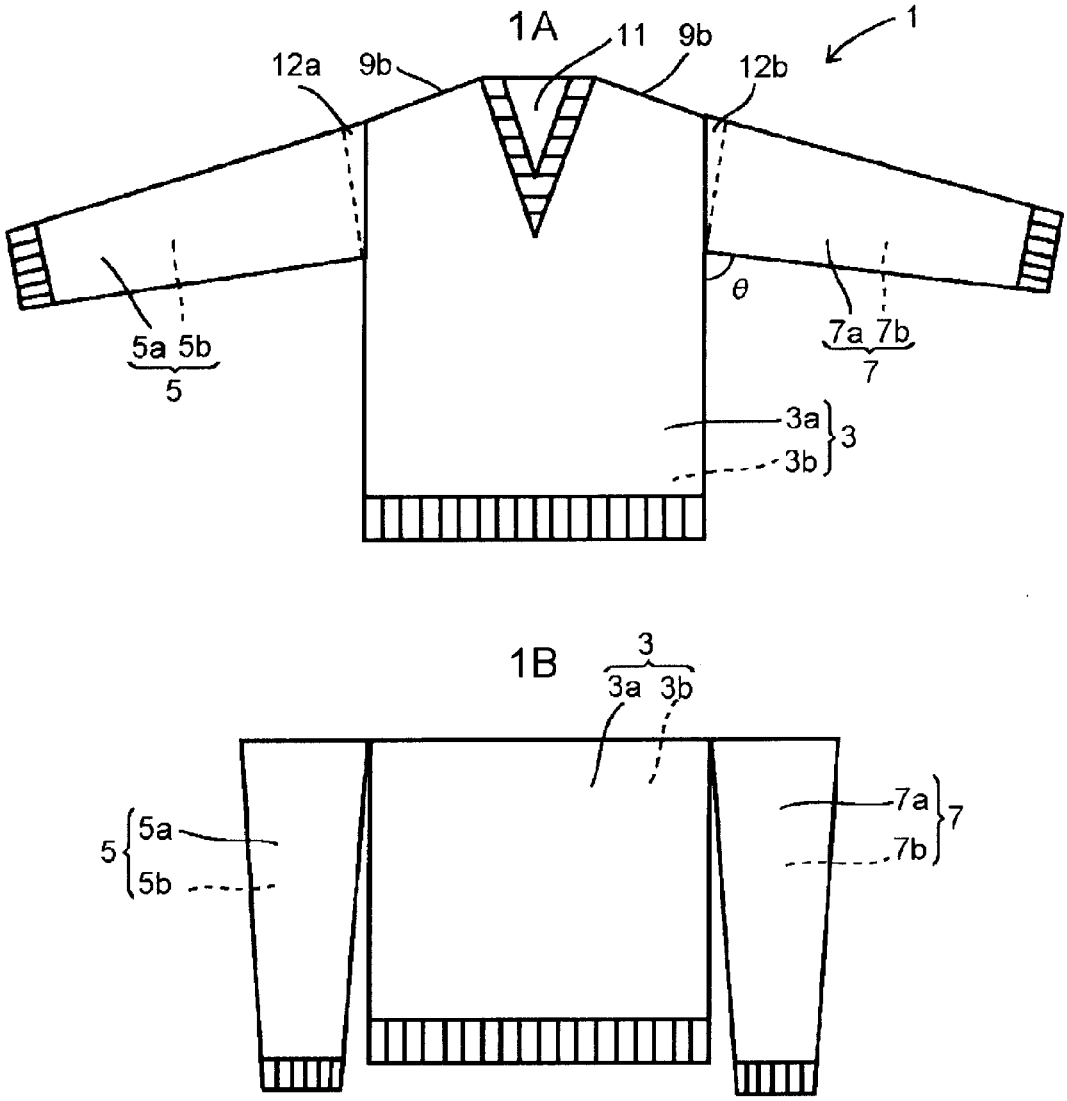
FIG. 1A shows sweater after the completion of joining of the sleeves and the body.
FIG. 1B shows sweater before the start of joining of the sleeves and the body.

A certain preferred embodiment of the present invention will be described with reference to the accompanying drawings. It is to be noted that the terms "right" and "left" in the right side and left side of sweater 1 appearing in the following description are intended to mean the right-hand part and the left-hand part of sweater 1 when viewing from the a wearer who wears the sweater. Also, in the course knitting diagrams of FIGS. 4–9, the numerals at the left side indicate the serial number of the courses; the vertical arrows at right side thereof indicate the stitch transfer direction; and the horizontal arrows indicate the knitting direction.

In the following, reference is made to knitwear knitted in the form of sweater having set-in sleeves of a plain knit structure knitted by using a two-bed flat knitting machine. The knitwear may be knitted to have another knit structure, such as jacquard and rib, or may be knitted by using a four-bed flat knitting machine. This knitwear can be knitted by using a general flat knitting machine comprising a pair of horizontally extending front and back needle beds which are arranged to confront each other in front and back and have a number of needles thereon. At least one of the front and back needle beds is racked laterally so that stitch transfer can be performed therebetween. In the flat knitting machine used in the illustrated embodiment, the back needle bed is racked relative to the front needle bed, and the needles for knitting a front knitted fabric and the needles for knitting a back knitted fabric are arranged in alternate position on the needle beds. The alternately arranged needles are used for knitting the front knitted fabric and the back knitted fabric, respectively, and empty needles are reserved for stitch transfer on the opposed needle beds. This arrangement enables the stitches on the needle bed to be shifted laterally in the process of knitting a tubular knitted fabric. On the other hand, when a four-bed flat knitting machine is used, the needles on the needle beds can all be used for knitting by using the needles on its upper needle bed, without any need to reserve the empty needles for stitch transfer between the alternately arranged knitting needles. In the following description, for better understanding of explanation, a fewer number of needles used for the knitting than the actual number of needles is illustrated. The sweater 1 comprises a body 3, a right sleeve 5 and a left sleeve 7. The body 3 and the right and left sleeves 5, 7 are knitted into a tubular form. The body 3 comprises a front body 3*a* and a back body 3*b*; the right sleeve 5 comprises a right front sleeve 5*a* and a left back sleeve 5*b*; and the left sleeve 7 comprises a left front sleeve 7*a* and a left back sleeve 7*b*. The right and left sleeves 5, 7 are joined to the body 3 in the joining region extending from underarms of the body 3 to shoulders of the same. The front body 3*a* and the back body 3*b* are joined to the body at the shoulders 9*a*, 9*b* and then are bound off to prevent from loosening of stitches in a known bind-off process. A neckline opening 11 is formed in the front body 3*a*. From the start of formation of the neckline opening 11, the front body 3*a* is forked into a right side and a left side to confront each other across the neckline opening 11.

In the illustrated embodiment, the sleeves 5, 7 and the body 3 are joined together in an alternating succession of the step 1 that each time when the front body 3*a* and the back body 3*b* are knitted in one course, the sleeves 5, 7 are shifted to and joined to the bodies 3*a*, 3*b* and the step 2 that the sleeves 5, 7 and the bodies 3*a*, 3*b* are both knitted to be joined together. The right sleeve 5 and the left sleeve 7 shown in FIG. 1A include parts 12*a*, 12*b* formed in the step 2, respectively. In the illustrated embodiment, the knitting to join together the sleeves 5, 7 and the bodies 3*a*, 3*b* is repeated ten times in a row in the step 1 and then the knitting to join together the sleeves 5, 7 and the bodies 3*a*, 3*b* is repeated twice in the step 2, whereby a sweater having a course number ratio of the sleeve to the body of 1:6 is knitted. In the illustrated embodiment, since the course number ratio of the sleeve to the body is set to be 1:6, the sweater 1 knitted comes to have a large sleeve attaching angle θ as shown in FIG. 1A. Knitwear having a smaller sleeve-attaching angle θ may be knitted by changing the course number ratio of sleeve to body. The higher the course number ratio of the body to the sleeve becomes, the larger the sleeve attaching angle θ becomes. On the other hand, the lower the course number ratio of the body to the sleeve becomes, the smaller the sleeve attaching angle θ becomes.

Figure 2:
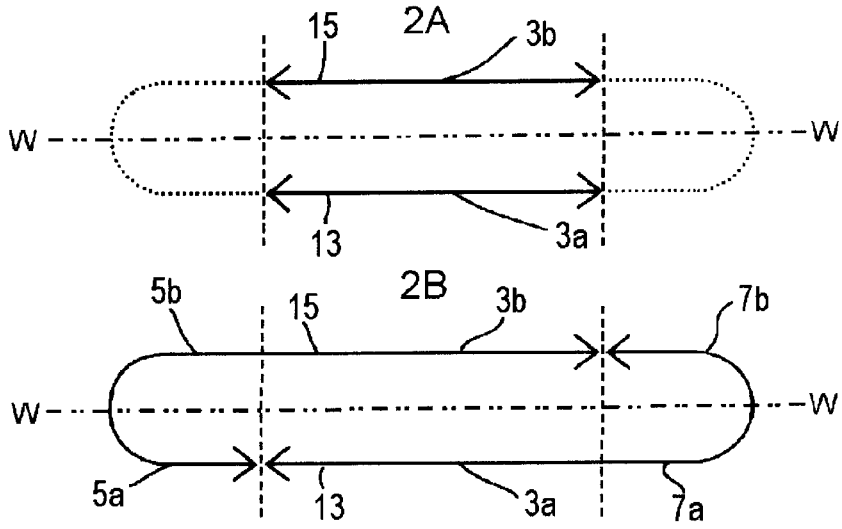
FIG. 2A shows the track of a yarn feeder in the step 1.
FIG. 2B shows the track of the yarn feeder in the step 2.
Figure 3:
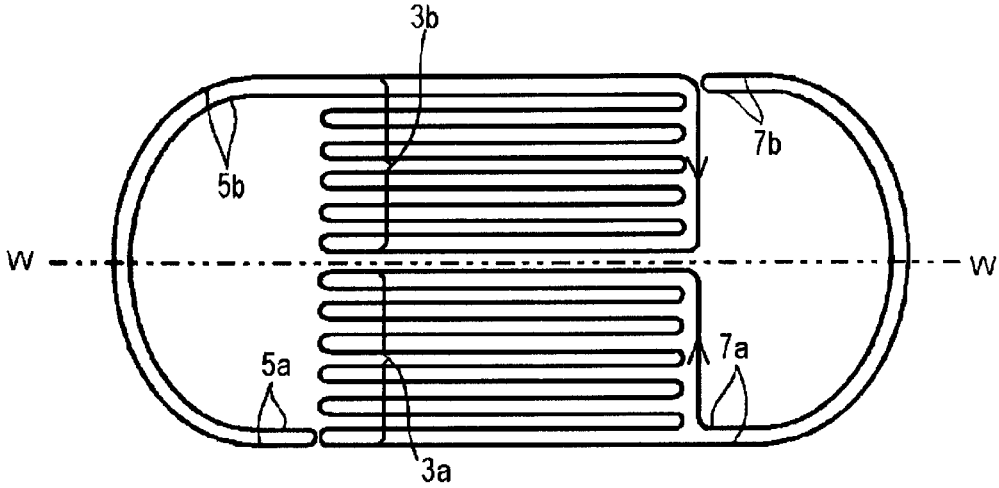
FIG. 3 shows a knitting sequence.

The tracks of yarn feeders and the knitting sequence of the knitting method of the illustrated embodiment are described with reference to FIGS. 2 and 3. While two yarn feeders are used in the illustrated embodiment, mote than two yarn feeders may be used for knitting. The line W—W of FIGS. 2 and 3 represents the boundary between a front fabric comprising the front body 3*a*, the right front sleeve 5*a* and the left front sleeve 7*a* and a back fabric comprising the back body 3*b*, the right back sleeve 5*b*, and the left back sleeve 7*b*. The body 3 is knitted in each of the steps 1 and 2, and the sleeves 5 and 7 are knitted in the step 2 only. In the step 1, as shown in FIG. 2A, the yarn feeder 13 is used to knit the front body 3*a*, and the yarn feeder 15 is used to knit the back body 3*b*. The yarn feeder 13 is turned back at both ends of the front body 3*a* to knit the front body 3*a* in a flechage knitting. The yarn feeder 15 is turned back at both ends of the back body 3*b* to knit the back body 3*b* in the flechage knitting. In the step 2, as shown in FIG. 2B, the yarn feeder 13 is used to knit the front body 3*a* and the left sleeve 7 in the shuttlewise knitting order of the front body 3*a*→the left front sleeve 7*a*→the left back sleeve 7*b*→the left back sleeve 7*b*→the left front sleeve 7*a*→the front body 3*a*, and the yarn feeder 15 is used to knit the back body 3*b* and the right sleeve 5 in the shuttlewise order of the back body 3*b*→the right back sleeve 5*b*→the right front sleeve 5*a*→the right front sleeve 5*a*→the right back sleeve 5*b*→the back body 3*b*.

Figure 4:
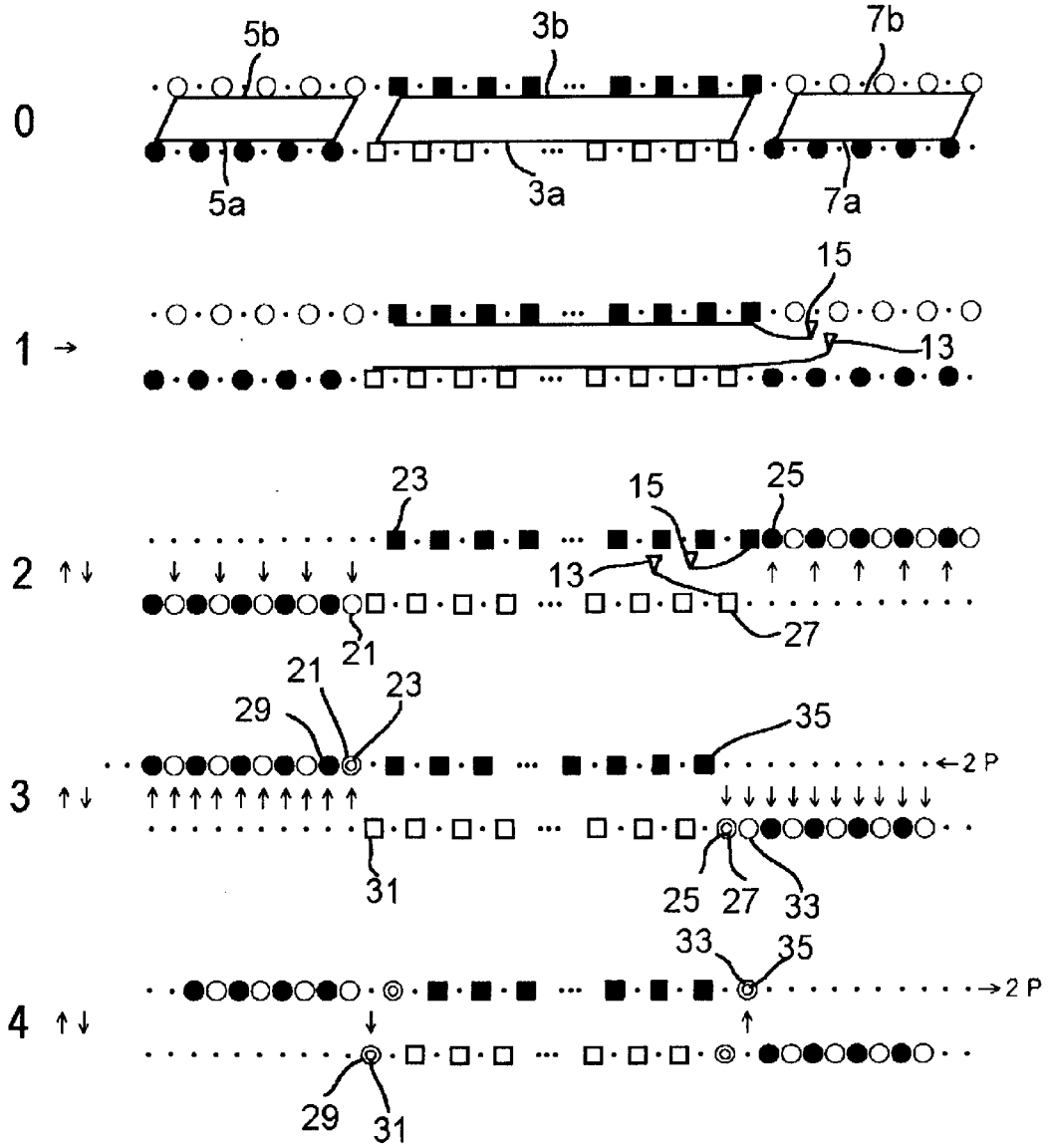
FIG. 4 is a knitting course diagram of the step 1.

Now, the step 1 will be described, starting at the course 0 of FIG. 4. The course 0 shows the state before the joining of the sleeves 5, 7 to the body 3. In the course 0, the right front sleeve 5*a* and right back sleeve 5*b*, and the left front sleeve 7*a* and left back sleeve 7*b* are retained at both outsides of the front body 3*a* and the back body 3*b*. In the knitting before the course 0, the front body 3*a* and the back body 3*b*; the right front sleeve 5*a* and the right back sleeve 5*b*; and the left front sleeve 7*a* and the left back sleeve 7*b* are knitted into tubular bodies, respectively. After the start of joining of the sleeves 5, 7 and the bodies 3*a*, 3*b*, the front knitted fabric comprising the front body 3*a*, the right front sleeve 5*a* and the left front sleeve 7*a* and the back knitted fabric comprising the back body 3*b*, the right back body 5*b* and the left back sleeve 7*b* are knitted to be continuous to each other at each end thereof, so as to be knitted into a large tubular fabric.

In the course 1, the yarn feeder 13 is used for the front body 3*a* and the yarn feeder 15 is used for the back body 3*b*, and the front body 3*a* is knitted by a leading cam system and the back body 3*b* is knitted by a trailing cam system. In the course 2, after the yarn feeders 13, 15 are kicked back to the left side, the stitches of the right back sleeve 5*b* are transferred to the front needle bed and the stitches of the front sleeve 7*a* are transferred to the back needle bed. In the course 3, after the back needle bed is racked leftwards two pitches, the stitches of the right front sleeve 5*a* and the right back sleeve 5*b* are transferred to the back needle bed, and the stitches of the left front sleeve 7*a* and the left back sleeve 7*b* are transferred to the front needle bed. Then, the stitch 21 at the side end of the right back sleeve 5*b* is laid over the stitch 23 of the back body 3*b* and the stitch 25 at the side end of the left front sleeve 7*a* is laid over the stitch 27 of the front body 3*a*. In the course 4, after the back needle bed is racked rightwards two pitches, the stitch 29 at the side end of the right front sleeve 5*a* is laid over the stitch 31 of the front body 3*a* and the stitch 33 at the side end of the left front sleeve 7*a* is laid over the stitch 35 of the back body 3*b*.

Figure 5:
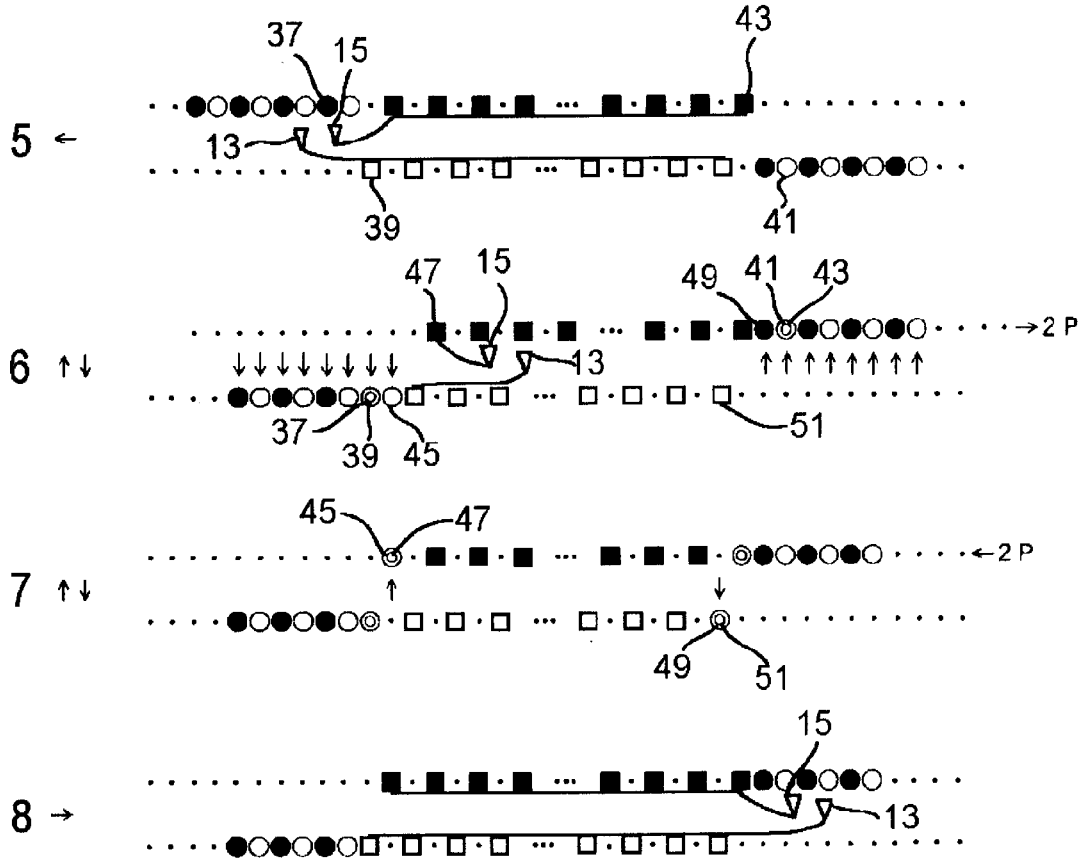
FIG. 5 is a knitting course diagram of the step 1.
Figure 6:
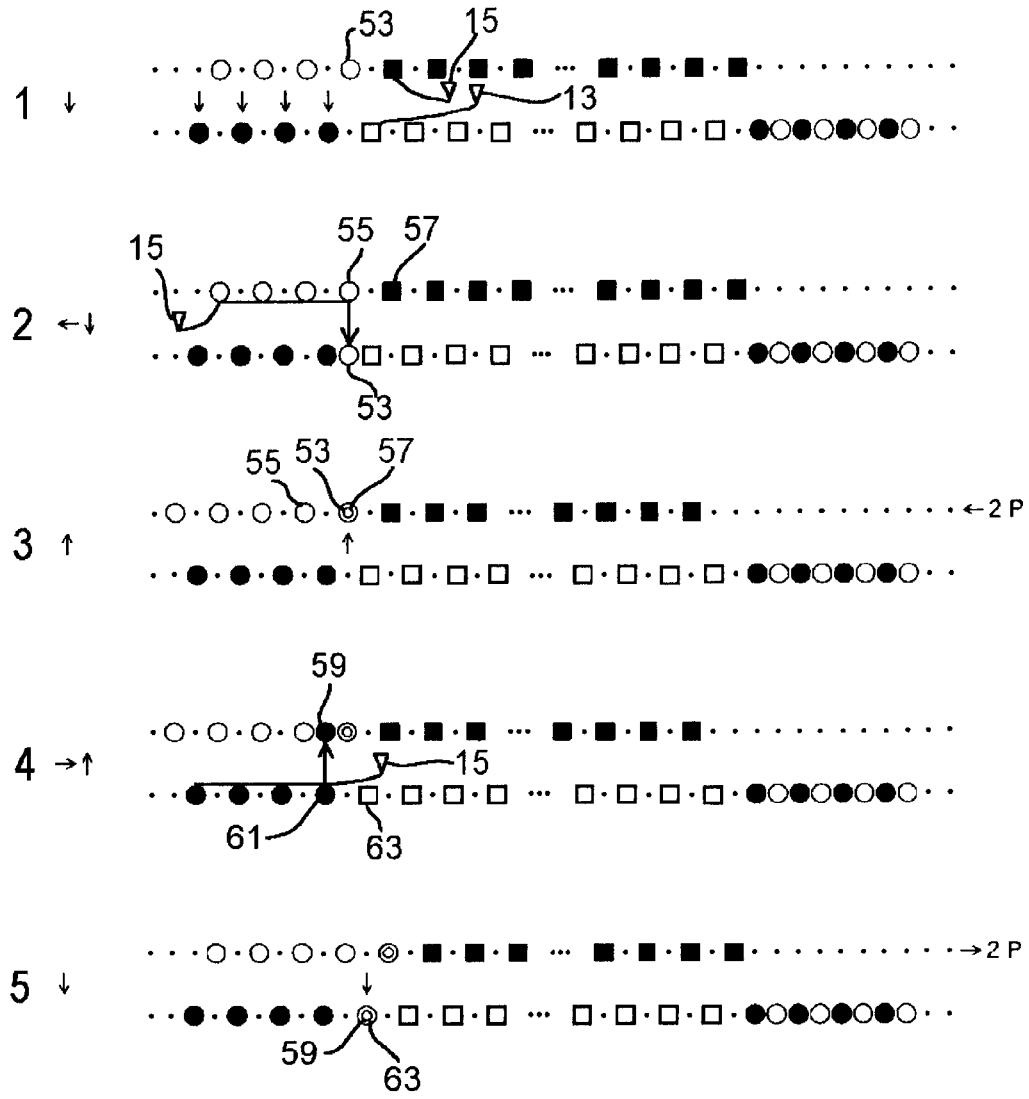
FIG. 6 is a knitting course diagram of the step 2.

Then, in the course 5 of FIG. 5, after the yarn feeders 13, 15 are kicked back to the right side, they are racked leftwards. Then, the front body 3*a* is knitted via the yarn feeder 13, and the back body 3*b* is knitted via the yarn feeder 15. In the knitting from the course 2 of FIG. 4 to the course 5 of FIG. 5, the stitches of the right front sleeve 5*a* and the left front sleeve 7*a* are laid over the stitches of the front body 3*a* and also the stitches of the back sleeves are laid over the stitches of the back body 3*b*, whereby the sleeves and the body are joined together. In the course 6, after the yarn feeders 13, 15 are kicked back to the right side, the back needle bed is racked rightwards two pitches. Then, the stitches of the right front sleeve 5*a* and the right back sleeve 5*b* are transferred to the front needle bed, and the stitches of the left front sleeve 7*a* and the left back sleeve 7*b* are transferred to the back needle bed. Then, the stitch 37 at the side end of the right front sleeve 5*a* is laid over the stitch 39 of the front body 3*a* and the stitch 41 at the side end of the left back sleeve 7*b* is laid over the stitch 43 of the back body 3*b*. In the course 7, after the back needle bed is racked leftwards two pitches, the stitch 45 at the side end of the right back sleeve 5*b* is laid over the stitch 47 of the back body 3*b* and the stitch 49 at the side end of the left front sleeve 7*a* is laid over the stitch 51 of the front body 3*a*. In the course 8, after the yarn feeders 13, 15 are kicked back to the left side, they are racked rightwards to knit the front body 3*a* and the back body 3*b*. After the knitting mentioned above, the joining of two stitches of each of the right front sleeve 5*a*, the right back sleeve 5*b*, the left front sleeve 7*a* and the left back sleeve 7*b* to the body is completed from the state of the course 0 of FIG. 4. When the knitting of the courses 2–5 of FIGS. 4–5 wherein the front body 3*a* and the back body 3*b* are knitted to the right side to be joined together and the knitting of the courses 6–8 of FIG. 5 wherein the front body 3*a* and the back body 3*b* are knitted to the left side to be joined together are taken as unit of repeated knitting operations, the unit of repeated knitting operations is repeated five times to complete the knitting of the step 1.

Then, the step 2 will be described, starting at the point of time the knitting of the step 1 up to the course 5 of FIG. 5 is completed. In the step 2, the sleeve and the body are both previously knitted and joined together at one sleeve side, e.g. at the right sleeve 5 side, and the other sleeve and the body are joined together at the left sleeve 7 side without knitting the other sleeve 7, first. Then, after the front body 3*a* and the back body 3*b* are knitted, the other sleeve and the body are both knitted and joined together at the left sleeve 7 side, while the one sleeve and the body are joined together, without knitting the one sleeve 5. In the course 1 of FIG. 6, after the yarn feeders 13, 15 are kicked back to the right side, the stitches of the right front sleeve 5*a* are transferred to the front needle bed. In the course 2, when the yarn is fed to the right back sleeve 5*b* by the yarn feeder 15 used for the knitting of the back body 3*b* in the step 1, a split knit is provided by the needle retaining thereon the stitch 53 positioned at the side end of the right back sleeve 5*b* next to be laid over the stitch of the body. Then, the stitch 53 is transferred on to the opposite needle bed and also an additional stitch 55 is additionally formed. The knitting is performed by other needles than that needle to form stitches of the next course in the right back sleeve 5*b*. In the course 3, after the back needle bed is racked leftwards two pitches, the stitch 53 is laid over the stitch 57 of the back body 3*b*. In the course 4, after the yarn feeder 15 is reversed in direction at the left end of the right sleeve 5, the yarn is fed to the right front sleeve 5*a* to form the stitches of the next course and also a split knit is provided for the stitch 59 at the side end of the right front sleeve 5*a* next to be laid over the stitch of the front body 3*a*. Then, the stitch 59 is transferred on to the back needle bed and also an additional stitch 61 is formed. In the course 5, after the back needle bed is racked rightwards two pitches, the stitch 59 is laid over the stitch 63 at the side end of the front body 3*a*.

Figure 7:
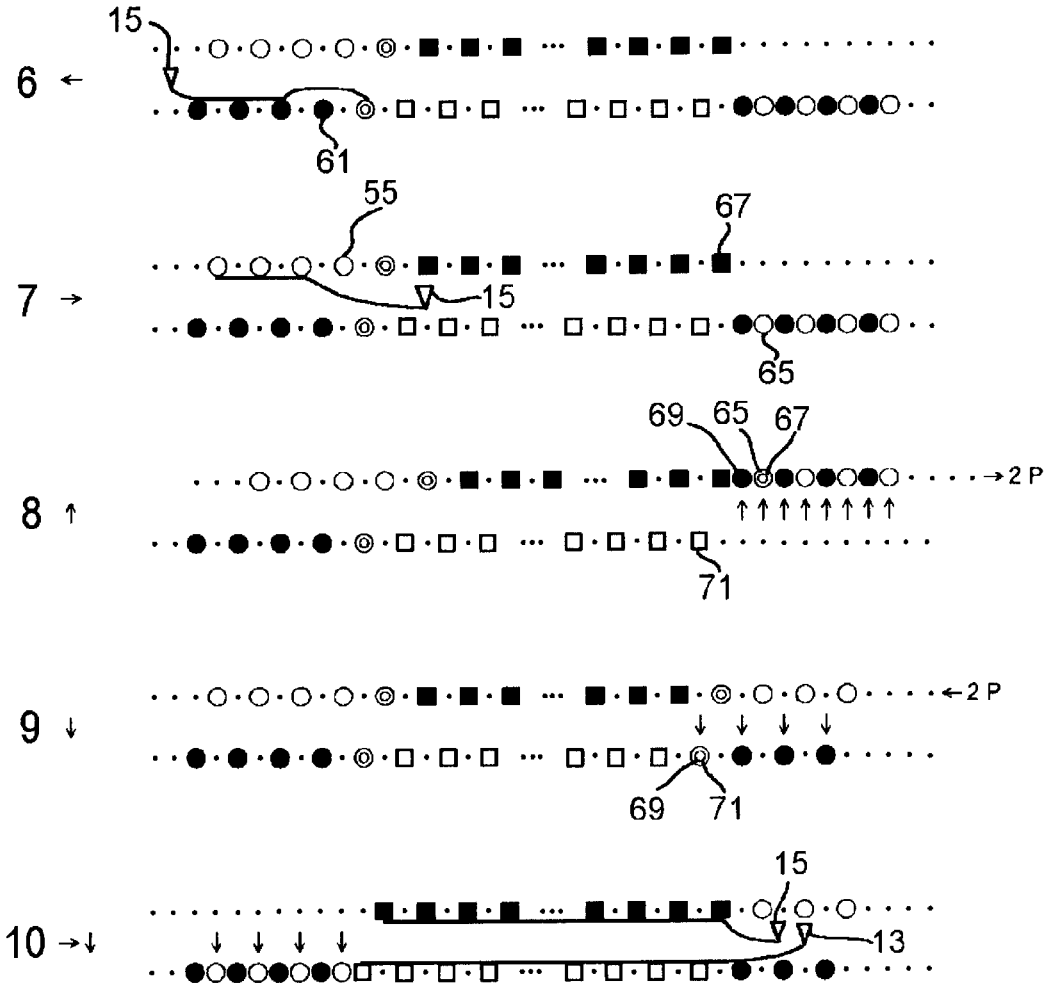
FIG. 7 is a knitting course diagram of the step 2.

In the course 6 of FIG. 7, after the yarn feeder 15 is reversed in direction at the right end of the right front sleeve 3*a*, the yarn is fed to the right front sleeve 5*a* again. At this point of time, the needle retaining thereon the stitch 61 for which the split knit was provided in the course 4 is missed. The yarn is fed to the other needles than that needle to form the stitches of the next course in the right front sleeve 5*a*. In the course 7, as is the case with the course 6, the needle retaining thereon the stitch 55 for which the split knit was provided in the course 2 is missed, and the stitches of the next course are formed on the other stitches of the right back sleeve 5*b* than that stitch 55. In the course 8, after the back needle bed is racked rightwards two pitches, the stitches of the left front sleeve 7*a* and the left back sleeve 7*b* are transferred to the back needle bed, and the stitch 65 at the side end of the left back sleeve 7*b* are laid over the stitch 67 of the back body 3*b*. In the course 9, after the back needle bed is racked leftwards two pitches, the stitches of the left front sleeve 7*a* are transferred to the front needle bed, and the stitch 69 at the side end of the left front sleeve 7*a* is laid over the stitch 71 of the front body 3*a*. In the course 10, the yarn feeders 13, 15 are kicked back to the left side, they are racked rightwards. Then, the front body 3*a* and the back body 3*b* are knitted via the yarn feeder 13 and the yarn feeder 15, respectively, and also the stitches of the right back sleeve 5*b* are transferred to the front needle bed.

Figure 8:
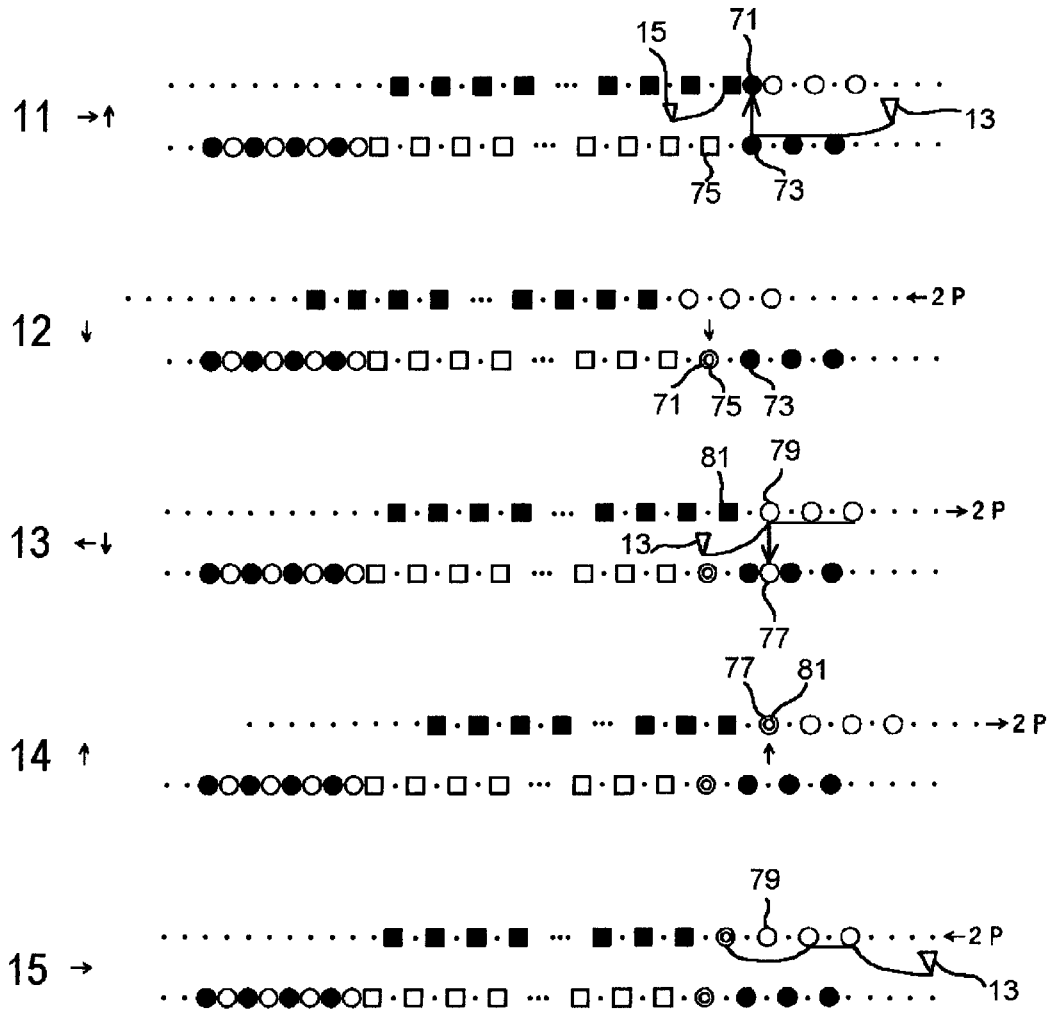
FIG. 8 is a knitting course diagram of the step 2.

In the course 11 of FIG. 8, the yarn feeders 13, 15 are kicked back to the left side. Then, when the yarn is fed to the left front sleeve 7*a* by the yarn feeder 13, a split knit is provided by the needle retaining thereon the stitch 71 of the left front sleeve 7*a* next to be laid over the stitch of the body and an additional stitch 73 is formed. The knitting is performed by other needles than that needle to form stitches of the next course in the left front sleeve 7*a*. In the course 12, after the back needle bed is racked leftwards two pitches, the stitch 71 is laid over the stitch 75 of the front body. In the course 13, after the back needle bed is racked rightwards two pitches, the yarn feeder 13 is reversed in direction, to form the stitches of the next course in the left back sleeve 7*b* and also a split knit is provided for the stitch 77 at the side end and an additional stitch 79 is formed. In the course 14, after the back needle bed is racked rightwards two pitches, the stitch 77 is laid over the stitch 81 of the front body 3*a*. In the subsequent course 15, after the back needle bed is racked leftwards two pitches, the yarn feeder 13 is reversed in direction at the left end of the left sleeve 7, to form the stitches of the next course in the left back sleeve 7*b*, except the stitch 79 for which the split knit was provided in the course 13.

Figure 9:
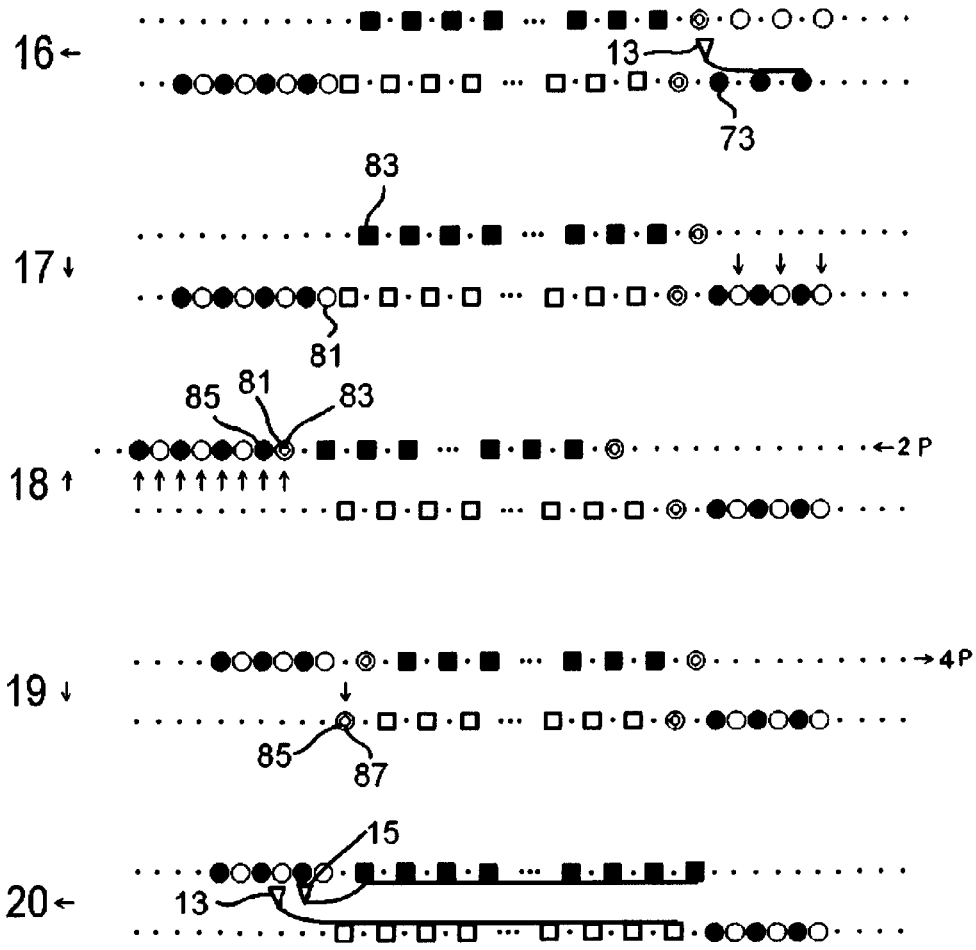
FIG. 9 is a knitting course diagram of the step 2.

In the course 16 of FIG. 9, the needle retaining thereon the additional stitch 73 additionally formed in the course 11 is missed, and the stitches of the next course are formed on the other stitches of the left front sleeve 7*a* than that stitch. In the course 17, the stitches of the left back sleeve 7*b* are transferred to the front needle bed. In the course 18, after the back needle bed is racked leftwards two pitches, the stitches of the right front sleeve 5*a* and the right back sleeve 5*b* are transferred to the back needle bed, and the stitch 81 at the side end of the left back sleeve 7*b* is laid over the stitch 83 of the back body 3*b*. In the course 19, after the back needle bed is racked rightwards four pitches, the stitch 85 at the side end of the right front sleeve 5*a* is laid over the stitch 87 of the front body 3*a*. In the course 20, after the yarn feeders 13, 15 are kicked back to the right side and racked leftwards, the stitches of the next course are formed in the front body 3*a* and the back body 3*b*. In the step 2, the knitting of the courses 2–20 of FIGS. 6–9 taken as the unit of repeated knitting operations is repeatedly performed. In the illustrated embodiment, the knitting is not repeated but is returned to the knitting of the step 1 from the course 6 of FIG. 5, in order to reduce the course number ratio of the sleeve. In the subsequent knitting, the stitches 55, 61, 73 and 79 formed by the split knit are laid over the stitches of the front and back bodies 3*a*, 3*b*. Subsequently, the knitting operations of the step 1 and the knitting operations of the step 2 are alternately performed to join together the sleeves and the body. In the area where the neckline opening 11 is formed, a yarn feeder used for the left side of the neckline opening 11 is added so that the two parts of the knitwear at the right and left sides of the neckline opening 11 can be knitted by the different yarn feeders, respectively. After the joining of the sleeves 5, 7 and the body 3 is completed in the knitting method mentioned above, the front body 3*a* and the back body 3*b* are joined together at their shoulder portions 9*a*, 9*b* to complete the sweater 1.

Figure 10:
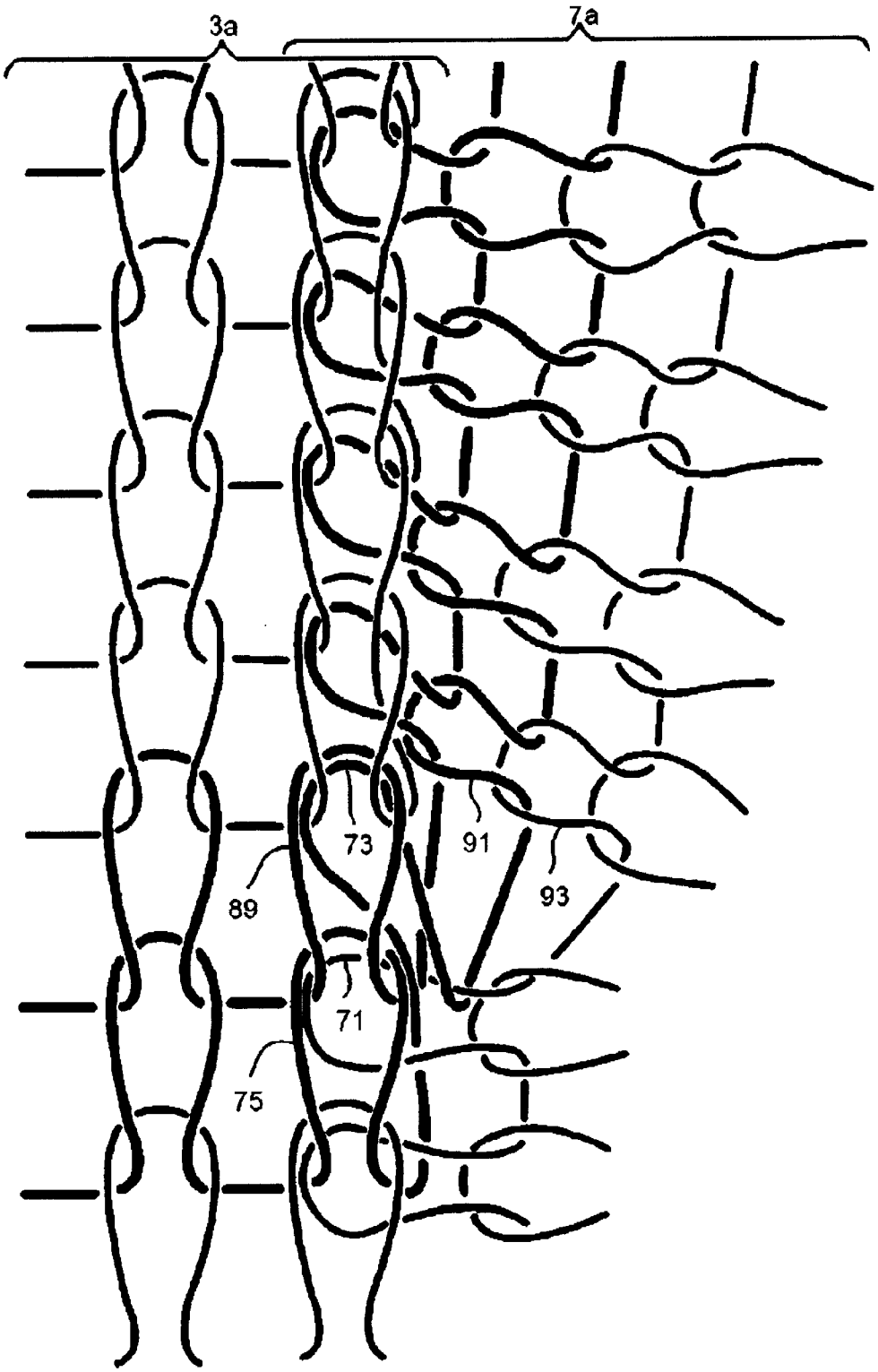
FIG. 10 is a loop diagram in a joining region where a front body and a left front sleeve are joined together.

The loop diagram at the joining part of the left front sleeve 7*a* and the front body 3*a* of the sweater 1 knitted in the knitting method mentioned above is shown in FIG. 10. In FIG. 10, the stitches formed in the knitting of the step 2 are represented by a bold line. In the sweater 1, the sleeves and the body are joined together by the stitches of the last course of the left front sleeve 7*a* being laid over the stitches at the end of the front body 3*a*. In the embodiment of the present invention, since the knitting of the front body 3*a* and the knitting of the back body 3*b* are concurrently performed and the joining of the front sleeves 5*a*, 7*a* and the front body 3*a* and the joining of the back sleeves 5*b*, 7*b* and the back body 3*b* are concurrently performed by using a plurality of yarn feeders, the sleeves and the body can be joined together without any difference in knitting width between the front knitted fabric and the back knitted fabric that may cause yarn rupture or stretched stitch. In addition, in the embodiment of the present invention, the split knit is provided for the stitch 71 at the side end in the sleeve knitting course, to form the additional stitch 73 and then the stitches 71 and 73 are joined to the stitches 75 and 89 in the different courses of the front body 3*a*. The stitch 73 formed by the split knit is formed in a smaller stitch form than the usual one, such that it draws in surrounding stitches 91, 93, and as such can allow the sleeves and the body to be joined together closely without leaving any undesirable space therebetween, thus producing a good-looking joining line.

Figure 11:
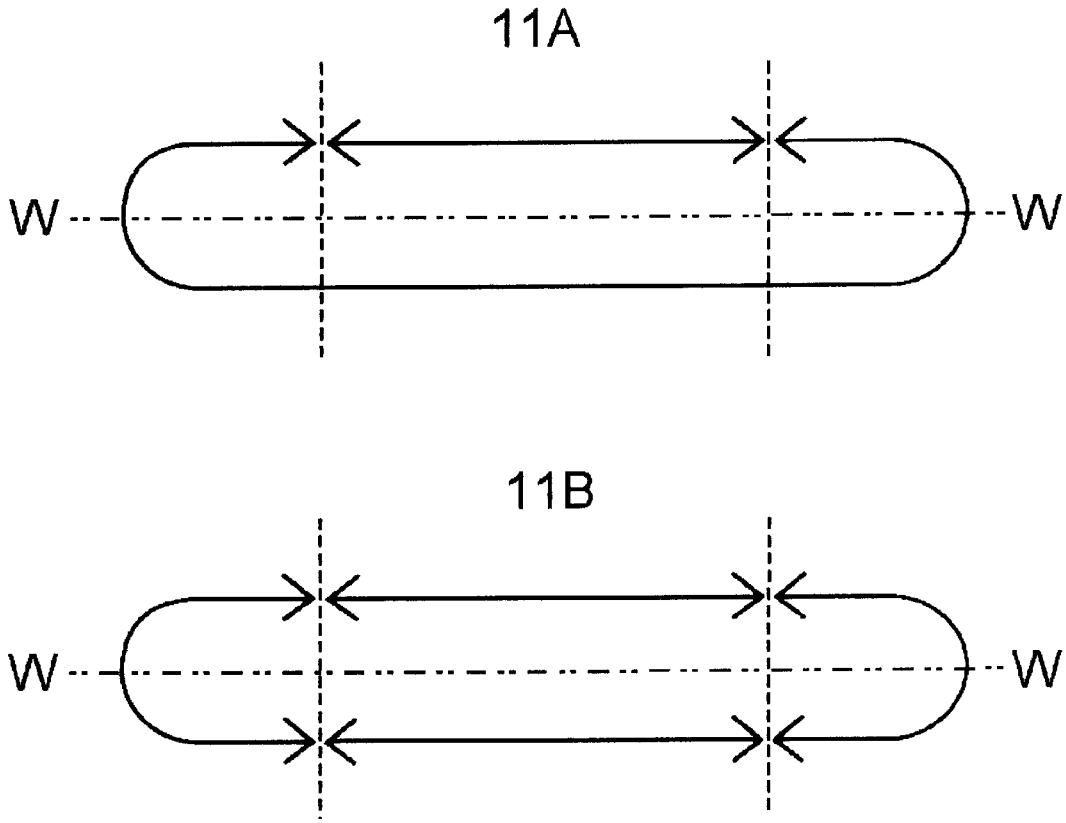
FIG. 11A show another embodiment.
FIG. 11B shows still another embodiment.
Figure 12:
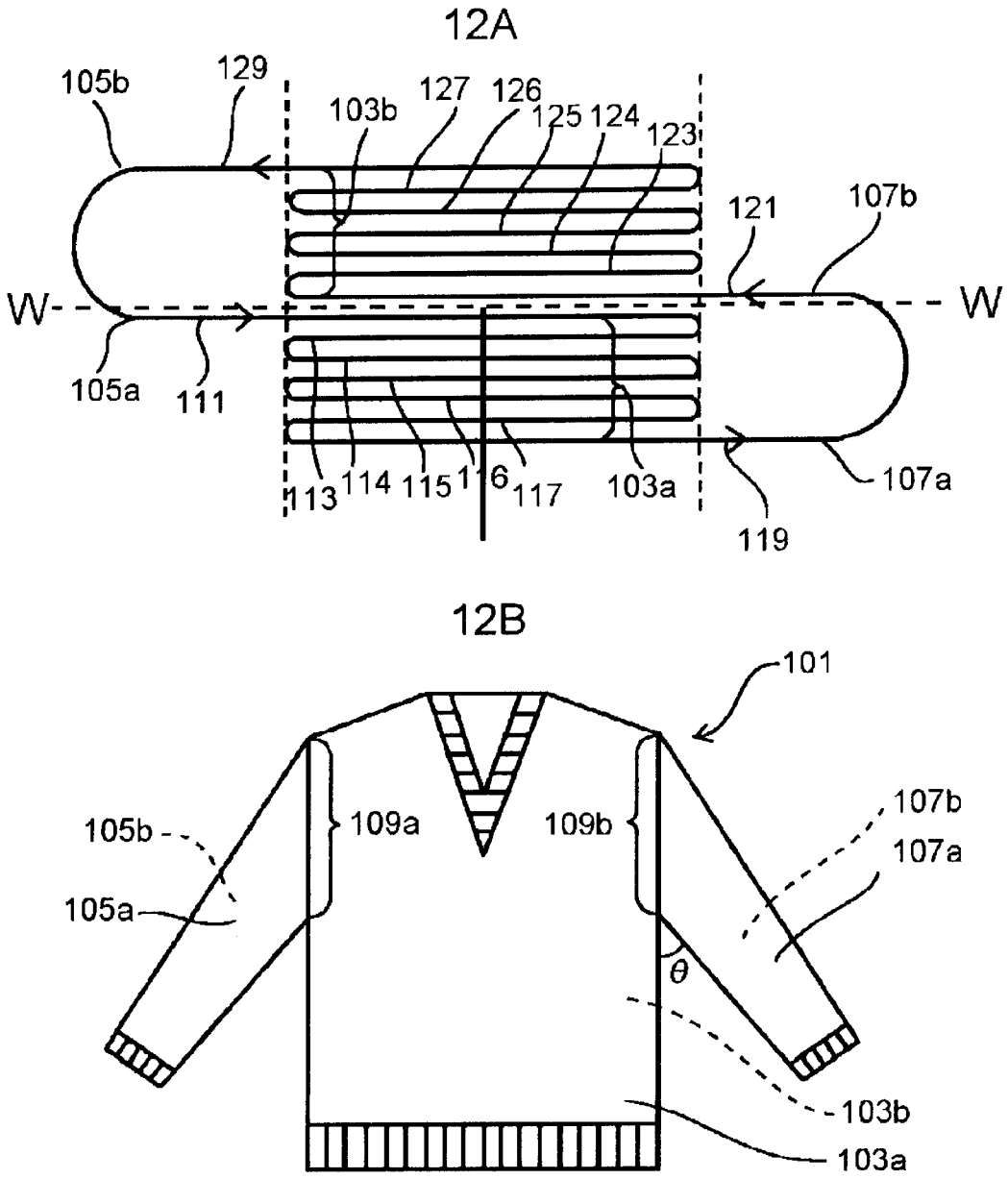
FIG. 12A shows a knitting sequence of a conventional knitting method.
FIG. 12B shows a knitted fabric knitted in accordance with the knitting sequence of FIG. 12A.

While in the embodiment of the present invention, the body is overlapped with the sleeves whenever the body is knitted in one course, the body may be overlapped with the sleeves whenever the body is knitted in two courses or more. Also, such modification may be made that the front body 3*a* and the right and the left sleeves 5, 7 may be knitted by the same yarn feeder, while only the back body 3*b* may be knitted by another yarn feeder, as shown in FIG. 11A. Alternatively, the front body 3*a*, the back body 3*b*, the right sleeve 5 and the left sleeve 7 may be knitted by their respective yarn feeders, as shown in FIG. 11B. Although the knitting method has been described above, taking the sweater as one example of the knitwear, the present invention is applicable to the knitting of cardigan or other knitwear. Further, the course number ratio of the sleeve to the body may be changed within the joining region of the sleeves and the body.

Capabilities of Exploitation in Industry

As evidence from the foregoing, according to the present invention, the knitwear having a good-looking joining line along which the sleeves and the body are joined together can be knitted at any selective sleeve attaching angle. Also, since the course for only the body to be knitted to join together the sleeves and the body is increased in course number as compared with the course for both the sleeves and the body to be knitted to join together the sleeves and the body, the knitwear having the sleeves which are joined to the body at nearly right angle can be knitted without using any special yarn such as an elastic yarn.

What is claimed is:

1. A method of knitting knitwear, comprising a body knitted into a tubular fabric whose front body and back body are overlapped with each other in front and back; and right and left sleeves situated at each side of the body and each formed into a tubular fabric whose front sleeve and back sleeve are overlapped with each other in front and back, by using a flat knitting machine comprising at least a pair of first and second needle beds each having a number of needles, which are placed opposite in front and back and at least either of which can be racked laterally; yarn feeders for feeding yarn to the needles of the first needle bed and second needle bed; and a cam unit, the method comprising the joining knit step that whenever a predetermined number of courses of the body is knitted in a joining region extending from an underarm to a shoulder, the sleeves are shifted to the body to allow the stitches of the last course of the sleeves to be laid over the stitches of the body, so as to join together the sleeves and the body, the joining knit step comprising:

a) the step that whenever an adequate number of courses of the front body and the back body are knitted by using different yarn feeders, the right and left sleeves are shifted to the body side and joined together; and b) the step that when the front body and the back body are knitted by the different feed yarns, respectively, and the yarn is fed to either of the right and left sleeves to form stitches in the next course, split knit is provided for stitches of the front sleeves and back sleeves at side ends thereof on the body side and then each of the split stitches are laid over the stitches of the different courses in the bodies to join together the sleeves and the body.

2. The method of knitting knitwear according to claim 1, wherein a course number ratio of the sleeve to the body after the start of the joining knit of the sleeve and the body is set so that a course number ratio of the body can be higher than 1:4.

* * * * *